US009795939B2

(12) United States Patent
Hammonds

(10) Patent No.: US 9,795,939 B2
(45) Date of Patent: Oct. 24, 2017

(54) APPARATUS FOR MIXING AND BLENDING OF AN ADDITIVE MATERIAL INTO A FLUID AND METHOD

(71) Applicant: Hammonds Technical Services, Inc., Houston, TX (US)

(72) Inventor: Carl L. Hammonds, Hot Springs Village, AK (US)

(73) Assignee: Hammonds Technical Services, Inc., Houston, TX (US)

( * ) Notice: Subject to any disclaimer, the term of this patent is extended or adjusted under 35 U.S.C. 154(b) by 0 days.

(21) Appl. No.: 15/621,528

(22) Filed: Jun. 13, 2017

(65) Prior Publication Data

US 2017/0274334 A1 Sep. 28, 2017

Related U.S. Application Data

(62) Division of application No. 14/505,228, filed on Oct. 2, 2014.

(51) Int. Cl.
*B01F 15/02* (2006.01)

(52) U.S. Cl.
CPC ..... *B01F 15/0227* (2013.01)

(58) Field of Classification Search
CPC ..... B01F 15/0227
See application file for complete search history.

(56) References Cited

U.S. PATENT DOCUMENTS 3,994,480 A * 11/1976 Fothergill ..... B01F 5/0057 239/697
5,468,066 A * 11/1995 Hammonds ..... B01F 1/00 366/139

* cited by examiner

*Primary Examiner* — Abbas Rashid
(74) *Attorney, Agent, or Firm* — Crain, Caton & James, P.C.; James E. Hudson, III

(57) ABSTRACT

Apparatus and method in which a solid or liquid additive is dispensed within a mixing chamber for mixing with a fluid from the pressurized fluid flow line and is effective mixed in a vortex under vacuum while precluding contamination of the unused additive.

3 Claims, 3 Drawing Sheets

APPARATUS FOR MIXING AND BLENDING OF AN ADDITIVE MATERIAL INTO A FLUID AND METHOD

CROSS REFERENCE TO RELATED APPLICATIONS

This application is a divisional of U.S. patent application Ser. No. 14/505,228, filed on Oct. 2, 2014, which is incorporated herein by reference.

STATEMENT REGARDING FEDERALLY SPONSORED RESEARCH OR DEVELOPMENT

Not Applicable.

BACKGROUND

1. Field

The present disclosure provides an apparatus and method for introducing an additive material into a pressurized fluid flow line. More particularly, the disclosure provides an apparatus and method in which a solid or liquid additive is dispensed within a mixing chamber for mixing with the fluid from the pressurized fluid flow line and is effective mixed.

2. Description of the Related Art

Apparati for introducing an additive material into a fluid flow line are well known. This includes a dispersing apparatus for metering a dry particulate material into a liquid utilizing a feed rate rod adjustably moveable vertically to stop or meter the flow into the liquid supply. This also includes a dispersing apparatus for metering the dispersing of dry particulate material into a liquid using a cylindrical mixing container, a mixing chamber liquid inlet generally tangentially disposed, a particulate supplying unit having a supply unit outer piping and a particulate supply unit particulate inlet.

Unfortunately, the prior art does not effectively address each of the myriad of handling issues specific to problematic additive materials due the additive's physical characteristics. Additive materials may be difficult to place into solution, may be shear sensitive, may be difficult to "wet" during the blending process, may tend to form unblended collections or unwetted product, particularly in the case of polymers, and may provide difficult to convey to the blending device depending on the volume of additive. Moreover, these additives may be subject to contamination immediately prior to or following a blending event. Further, these additives may pose health issues requiring isolation not only from atmosphere, but from personnel.

It is known in the prior art that dry additives may produce dust and or fumes that present safety and maintenance issues with equipment and may pose a danger to operating personnel who must be in close proximity to the blending process. Dry polymers, for example, tend to dust into the atmosphere during the conveying process and float to surfaces adjacent to the blending equipment, immediately resulting in waste. Upon absorption of moisture from the atmosphere, this dry polymer dust may then form a surface coating presenting both a safety issue for personnel and the need for extensive cleaning to remove the film. Silica sand and other dry additives used in high volumes for hydraulic fracturing in the oil field, for example, are subject to undesirable contamination. During blending of such large volumes, the dust generated carries silica, which poses a health hazard.

It is also known in the prior art that additives create handling difficulties at the beginning or end of a blending cycle when blending with a liquid. The beginning or end of a mixing or blending event would often create partial or complete clogging as there has been no clear method of preventing contact between the product and blending liquid.

Similarly, it is known in the prior art that isolating the moisture-sensitive material from the fluid cylindrical mixing container can prove difficult. In these systems, it has been difficult to prevent moisture migrating from the cylindrical mixing container to the moisture-sensitive material immediately adjacent to the separation point of the apparatus. As a result, over time, the additive material has been known to absorb moisture and clump, preventing a free flowing of product during subsequent feed/blending events.

Thus, there is a need for an apparatus and method of use which blends a variety of problematic liquid and dry materials into a closed, pressurized liquid line, which permits initiation and cessation of blending events without adversely affecting the process such as by clogging or changes in handling characteristics of the product following periods of inactivity, and which conveys the product to a cylindrical mixing container without contamination from the atmosphere. There is a further need for an apparatus and method of use which conveys the product from large bulk storage without the need of augers, pumps and other mechanical means of transport, which prevents contamination of moisture sensitive materials at the point of interface with liquid, and which precisely controls the delivery rate of product to a liquid mixing process. Finally, there is a need for an apparatus and method of use which precisely adjusts the energy acting on the product during the mixing process and which provides an alternate method of packaging of difficult materials.

SUMMARY

It is therefore, a principle object of the present disclosure to provide an apparatus for mixing of an additive material into a fluid and method of use which includes a cylindrical mixing container, an additive supply unit, a linear actuator coupled to the additive supply unit and adapted to withdraw the additive supply unit from the cylindrical mixing container to a point above an isolating valve, an outlet line adapted for connection to the cylindrical mixing container at its outlet and to an inlet of a pump, a fluid supply adapted for communication with a restricting valve which is adapted for communication with a liquid inlet to the cylindrical mixing container. The cylindrical mixing container is constructed to have a mixing container top side, a mixing container bottom side, a mixing container sidewall. The cylindrical mixing container has a cylindrical mixing container outlet through the mixing container bottom wall aligned with the longitudinal cylindrical mixing container axis. The cylindrical mixing container has a cylindrical mixing container liquid inlet through the mixing container sidewall bounded at a cylindrical mixing container inlet bottom by the cylindrical mixing container bottom wall and is generally tangentially disposed to an inner peripheral surface of the cylindrical mixing container. The additive has an additive supply unit longitudinal axis aligned with the longitudinal cylindrical mixing container axis, an additive supply unit outer piping having an additive supply unit outer piping top end and an additive supply unit outer piping bottom end, an additive supply unit inlet into the additive supply unit outer piping at the additive supply unit outer piping top end, and an additive supply unit shaft slidably positioned within the additive supply unit outer piping from the supply unit outer piping top end to beyond the supply unit outer piping bottom end. The apparatus further includes an additive supply unit collar at the supply unit outer piping bottom end maintaining the additive supply unit shaft on the additive supply unit longitudinal axis. An additive supply unit disc is affixed perpendicular to the additive supply unit shaft at the bottom end of the additive supply unit shaft, and a motor is coupled to the additive supply unit shaft.

A method is further provided for the apparatus, wherein the isolating valve is opened, the additive supply unit outer piping bottom end is deployed into the cylindrical mixing container, and the additive supply unit shaft and the additive supply unit disc are rotated. A vacuum is drawn on the cylindrical mixing container, and the restricting valve is opened to permit communication of the fluid from the fluid supply to the cylindrical mixing container liquid inlet. The additive material is introduced into the additive supply unit outer piping at the additive supply unit inlet, the additive supply unit outer piping bottom end is retracted out of the cylindrical mixing container. The isolating valve is closed.

The apparatus thereby provides a smooth, continuous introduction of an additive into a flow stream without cross contamination of the product or blending system between times of operation.

The foregoing and other objectives, features and advantages of the disclosure will be more readily understood upon consideration of the following detailed description of the disclosure, taken in conjunction with the accompanying drawings.

BRIEF DESCRIPTION OF THE DRAWINGS

So that the manner in which the described features, advantages and objects of the disclosure, as well as others which will become apparent, are attained and can be understood in detail, more particular description of the disclosure briefly summarized above may be had by reference to the embodiments thereof that are illustrated in the drawings, which drawings form a part of this specification. It is to be noted, however, that the appended drawings illustrate only a typical preferred embodiment of the disclosure and are therefore not to be considered limiting of its scope as the disclosure may admit to other equally effective embodiments.

DETAILED DESCRIPTION OF THE PREFERRED EMBODIMENT

Figure 1:
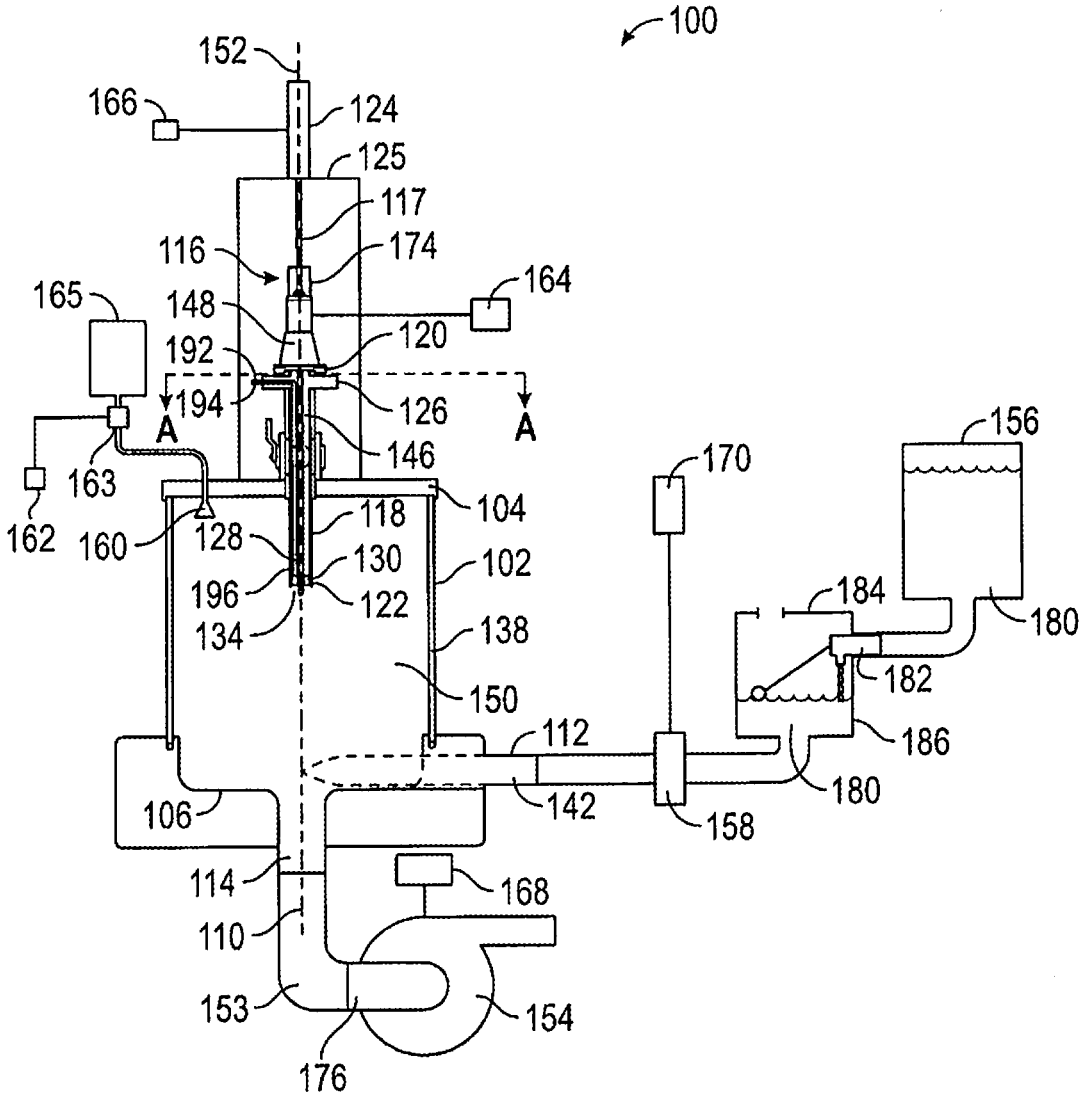
FIG. 1 illustrates a side view of an embodiment of the apparatus in a deployed or second position.

Referring now to FIG. 1, a side view of an embodiment of an apparatus 100 for mixing and blending of an additive material 190 into a fluid 180 is illustrated in a deployed or second position. The apparatus includes a vertically-oriented cylindrical mixing container 102 and an additive supply unit 116, together with a linear actuator 124 coupled to the additive supply unit 116, an outlet line 153 in communication with the cylindrical mixing container 102, and a fluid supply 156, which may be a container, in communication, via a pressure controller 184 and a restricting valve 158, with the cylindrical mixing container. The additive 190 may be a liquid or solid and may be a combination of additives. The fluid 180 from the fluid supply 156 is preferably provided to the cylindrical mixing container 102 at a predetermined or adjusting pressure by a pressure controller 184, which may be accomplished by maintaining a level of the fluid 180 in a pressure controller tank 186 at a constant level, such as by use of a float valve 182, or other systems known in the art, to maintain a level of fluid 180, in connection with an open, i.e. vented to atmosphere, pressure controller tank 186, or by use of a another system configured to provide flow of the fluid 180 from the fluid supply 156 at a fixed and/or constant pressure. Where a pressure controller 184 incorporating a float valve 182 is used, the level of fluid 180 in the pressure controller 184 is maintained at a constant height, so that when fluid 180 is dispersed into the cylindrical mixing container 102, additional fluid 180 is permitted to enter the pressure controller 184 from the fluid supply 156. Alternatively, the pressure controller 184 may be adjusted to ensure the height of the vortex of the fluid 180 generated within the cylindrical mixing container 102 does not rise so far along the mixing container sidewall 138 as to result in fluid 180 rebounding onto the additive supply unit 116, potentially immediately altering the pressure of the fluid 180 entering the cylindrical mixing container 102 to compensate for the volume of additive material 190 being introduced.

Figure 2:
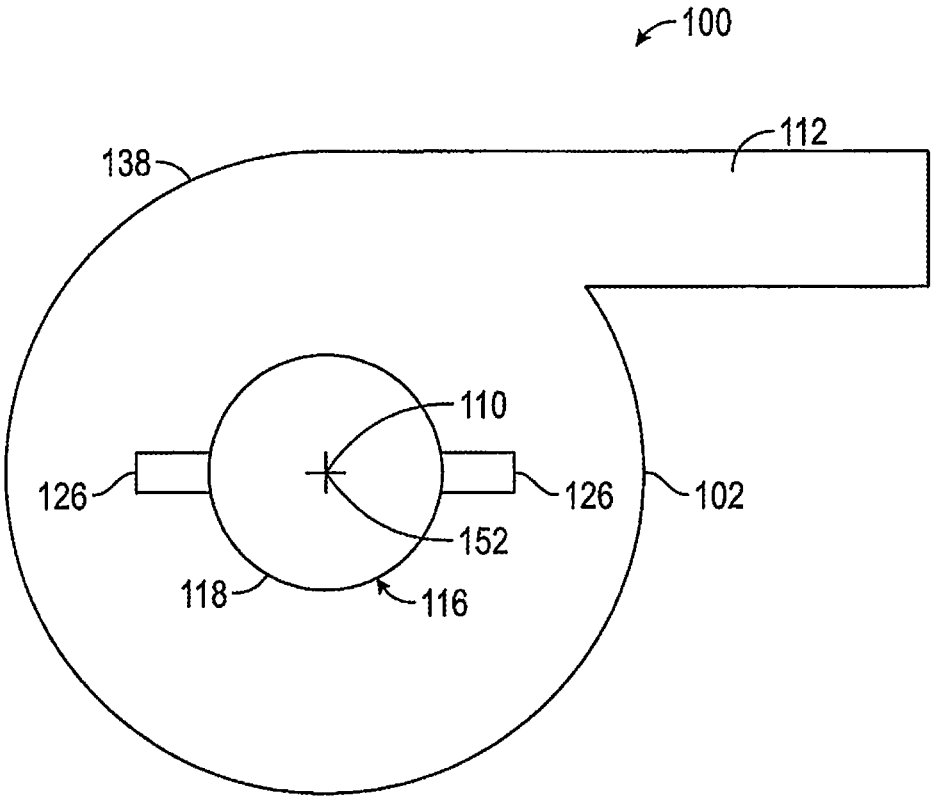
FIG. 2 illustrates a top view of an embodiment of the cylindrical mixing container when viewed downward along plane A-A.

The cylindrical mixing container 102, which is vertically oriented, provides a container for mixing or blending of a fluid 180 with an additive material 190, which additive material 190 may be liquid or solid in form. Mixing or blending is accomplished by generating a vortex of the fluid 180 within the cylindrical mixing container 102. The cylindrical mixing container 102 is defined by a mixing container top wall 104, a mixing container bottom wall 106, a mixing container sidewall 138, and a longitudinal cylindrical mixing container axis 110. The cylindrical mixing container 102 has a cylindrical mixing container outlet 114 which is positioned through the mixing container bottom wall 106 and which is aligned with the longitudinal cylindrical mixing container axis 110. The cylindrical mixing container 102 likewise has a cylindrical mixing container liquid inlet 112 through the mixing container sidewall 138 which is bounded at a cylindrical mixing container inlet bottom 142 by the cylindrical mixing container bottom wall 106 and which is generally tangentially disposed toward an inner peripheral surface 150 of the cylindrical mixing container 102. A top view of an embodiment of the apparatus when viewed downward from a plane A-A, provided in FIG. 1 equivalent with the additive supply unit inlet 126, is illustrated in FIG. 2, providing the cylindrical mixing container 102, the mixing container sidewall 138, the additive supply unit inlet 126, the outer piping 118, the additive supply unit 116, the cylindrical mixing container liquid inlet 112, the longitudinal cylindrical mixing container axis 110, and the additive supply unit longitudinal axis 152. One embodiment of the relative angle of the cylindrical mixing container liquid inlet 112 is illustrated in FIG. 2, showing the tangential alignment of the cylindrical mixing container liquid inlet 112 with respect to the mixing container sidewall 138 of cylindrical mixing container 102, preferably at the mixing container bottom wall 106.

Referring again to FIG. 1, addition of an additive material 190 is accomplished with the additive supply unit 116. The additive 190 may contain one or more selected additives in a predetermined ratio. The additive supply unit 116 has an additive supply unit longitudinal axis 152 aligned and coaxial with the longitudinal cylindrical mixing container axis 110, thus positing the additive supply unit in the center of the mixing container top wall 104. The additive supply unit 116 includes an additive supply unit outer piping 118, which has an additive supply unit outer piping top end 120 and an additive supply unit outer piping bottom end 122. The additive supply unit 116 has one additive supply unit inlet 126 into the additive supply unit outer piping 118 at the additive supply unit outer piping top end 120, but may have a plurality of additive supply unit inlets 126. The additive supply unit 116 further has an additive supply unit shaft 128 slidably positioned within the additive supply unit outer piping 118 from the supply unit outer piping top end 120 to beyond the supply unit outer piping bottom end 122. An additive supply unit collar 130 is positioned at the supply unit outer piping bottom end 122 to maintain the additive supply unit shaft 128 on the additive supply unit longitudinal axis 152. An additive supply unit centrifugal supply disc 134 is affixed perpendicular to the additive supply unit shaft 128 at a bottom end of the additive supply unit shaft 128. A motor 148 is coupled to the additive supply unit shaft 128. Additionally, the additive supply unit 116 includes an isolating valve 146 which is adapted to terminate communication between the additive supply unit outer piping 118 and the cylindrical mixing container 102 and which is positioned above the mixing container top wall 104.

Because the additive supply unit shaft 128 is slidably positioned within the additive supply unit outer piping 118, it provides for vertical adjustment of the additive supply unit shaft 128 and therefore the additive supply unit centrifugal supply disc 134. Vertical adjustment changes the clearance between the additive supply unit centrifugal supply disc 134 and the supply unit outer piping bottom end 122, allowing for adjustment of the amount of additive 190 that can exit the additive supply unit outer piping 118 and enter the additive supply unit outer piping 118. While the flow rate existing the additive supply unit outer piping 118 might be reduced to zero, the vertical adjustment of the additive supply unit shaft 128 is not intended primarily to function as a shut-off. A second linear actuator 174 may be coupled to the additive supply unit shaft 128 and adapted to retract the additive supply unit centrifugal supply disc 134 toward the supply unit outer piping bottom end 122 and to move the additive supply unit centrifugal supply disc 134 away from said supply unit outer piping bottom end 122.

Because the additive supply unit centrifugal supply disc 134 is affixed to the additive supply unit shaft 128, the additive supply unit centrifugal supply disc 134 rotates based on fixation to the additive supply unit shaft 128.

The motor 148 may be of any type, such as electric or fluid and may be of fixed or variable-speed operation. Operation of the motor 148 may be controlled by a motor controller 164. Moreover, the motor 148 may be coupled to the additive supply unit shaft 128 by any of various systems known in the art, but preferably is coupled so as to not to create a seal across the additive supply unit outer piping 118. Coupling may be accomplished, for example, by use of a magnet couple between the motor 148 and the additive supply unit shaft 128. A coupling which does not create a seal avoids the potential for creation of vacuum in the cylindrical mixing container 102 during retraction of the additive supply unit 116 from the cylindrical mixing container 102 from the second, deployed position depicted in FIG. 1 to a first, ready position and avoids pressurization of the cylindrical mixing container 102 during deployment of the additive supply unit 116 into the cylindrical mixing container 102 from a first, ready position to the second, deployed position.

The linear actuator 124 is coupled to the additive supply unit 116, such as by a shaft 117, and is adapted to withdraw the additive supply unit 116 from the cylindrical mixing container 102 and above the isolating valve 146. To the extent any additive 190 remains in the additive supply unit outer piping 118, it is isolated from the contents of the cylindrical mixing container 102 due to the retraction of the additive supply unit 116 by the linear actuator 124 and by the closure of the isolating valve 146. Operation of the linear actuator 124 may be controlled by a linear actuator controller 166. Operation of the isolating valve 146 may be controlled by an isolating valve controller 172. The isolating valve 146 may be of any type of valve providing a full closure, such as a ball valve.

The outlet line 153 is adapted for connection to the cylindrical mixing container outlet 114 and to an inlet 176 of a pump 154. Preferably, the pump 154 provides a negative pressure (vacuum), and preferably of 5-10", in the cylindrical mixing container 102 during operation. Operation of the pump 154 may be controlled by a pump controller 168.

The fluid supply 156 is adapted for communication, via the pressure controller 184, with the restricting valve 158, which is adapted for communication with the cylindrical mixing container liquid inlet. In operation, this permits the supply of a liquid 180, which may be contained in the fluid supply 156, to the cylindrical mixing container 102 at a constant, or first, pressure. Operation of the restricting valve 158 may be controlled by a restricting valve controller 170.

For operation, an additive 190 is introduced to the additive supply unit outer piping 118 at the additive supply unit inlet 126. The additive supply unit inlet 126 can be perpendicular, at an angle (such as to form a "y"), or can intersect the additive supply unit outer piping 118 tangentially to provide a cyclonic effect of the additive 190 upon entering the additive supply unit outer piping 118. An additive 190 may be composed of one or more selected additives.

Where desired, one or more fluid additive delivery nozzle 160 may be positioned inside the cylindrical mixing container 102 proximate the mixing container top wall 104. Where used, a fluid additive controller 162 may be used to control a fluid additive valve 163 provision of a fluid additive 164 to flow from an associated fluid additive reservoir or supply 165 to the fluid delivery nozzle 160 and into the cylindrical mixing container 102. More than one fluid additive 164, and therefore more than one fluid delivery nozzle 160 and more than one associated fluid additive reservoir or supply 165 may be utilized.

Additionally, where an additive 190 is a liquid, a liquid-delivery tube 192 having a liquid-delivery tube first end 194 and a liquid-delivery tube second end 196 may be positioned in and through the outer piping 118 from its first end 194 to its second end 196. to the other. As a result, the liquid-delivery tube 192 extends through the particle inlet 126 at the liquid-delivery tube first end 194 and terminates adjacent to the additive supply unit centrifugal supply disc 134 at the liquid-delivery tube second end 196. This provides liquid communication rather than communication of the solid additive 190. In operation, the liquid-delivery tube 192 is in fluid communication with a fluid additive reservoir or supply 165 of additive 190 so that a fluid additive 192 may be introduced rather than a solid additive 190.

Figure 3:
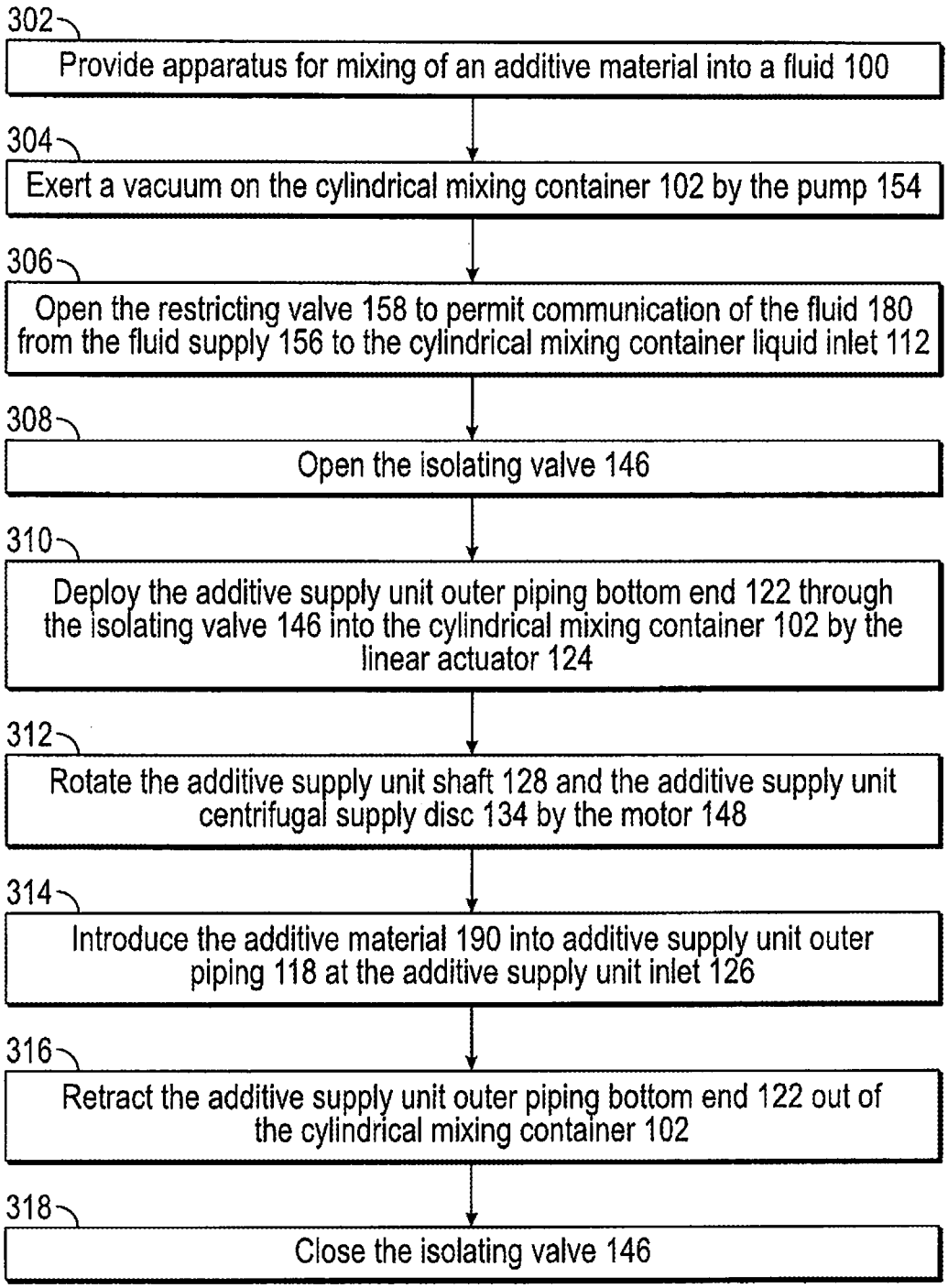
FIG. 3 illustrates a method of blending or mixing is accomplished according to the present disclosure.

In operation, blending or mixing is accomplished according to the method illustrated in FIG. 3.

Referring to FIG. 3, in step 302, the apparatus 100 is provided.

In step 304, a vacuum is exerted on the cylindrical mixing container 102 by the pump 154. Absent the exertion of a vacuum by pump 154, it is not possible to force the fluid 180, even if pressurized, into the cylindrical mixing container 102 and obtain a vortex. The combination of the pressurization of the fluid 180, due to its relative position, and the vacuum in the cylindrical mixing container 102 draws the fluid 180 into the cylindrical mixing container and causes formation of the vortex. The extent of the vacuum may be adjusted by the restricting valve 158.

In step 306, the restricting valve 158 is opened to permit communication of the fluid 180 from the fluid supply 156 to the cylindrical mixing container liquid inlet 112 at the first pressure via the pressure controller 184. A high energy vortex is formed by the fluid 180 in the cylindrical mixing container 102 due to the cylindrical construction of the cylindrical mixing container 102, the lower position and relative angle of the cylindrical mixing container liquid inlet 112, and the vacuum on the cylindrical mixing container 102 by the pump 154. Thus, the cylindrical mixing container 102 receives the fluid 180 through the cylindrical mixing container liquid inlet 112 tangentially at the mixing container bottom wall 106. The centrifugal force of the fluid 180 and the vacuum from the cylindrical mixing container outlet 114 cause the fluid 180 to form a vortex which eventually exits the cylindrical mixing container 102 through the cylindrical mixing container outlet 114 located in the mixing container bottom wall 106.

In step 308, the isolating valve 146 is opened.

In step 310, the additive supply unit outer piping bottom end 122 is deployed through the isolating valve 146 into the cylindrical mixing container 102 by the linear actuator 124, maintained in positive relative to the cylindrical mixing container 102 by a frame 125, preferably so the additive supply unit centrifugal supply disc 134 is vertically centered in the cylindrical mixing container 102. After the vortex is established in the cylindrical mixing container 102, the additive supply unit 116 is transported down into the cylindrical mixing container 102 where feeding begins based on the speed and vertical adjustment of the additive supply unit centrifugal supply disc 134. Since the centrifugal action of the additive supply unit centrifugal supply disc 134 projects the additive 190 horizontally from the additive supply unit centrifugal supply disc 134, the additive 190 contacts the nearly vertical wall of fluid 180 within the vortex undergoes blending. Volume and velocity of additive 190 as projected into vortex is thus controlled, and not a result of a gravity feed.

In step 312, the additive supply unit shaft 128 and the additive supply unit centrifugal supply disc 134 are caused to rotate by the motor 148.

In step 314, the additive material 190 is introduced into additive supply unit outer piping 118 at the additive supply unit inlet 126. During operation, the rate of additive 190 delivered to the fluid 180 in the resulting high energy vortex in cylindrical mixing container 102 is a function of the speed of the motor 148, and therefore the additive supply unit centrifugal supply disc 134, the feed rate of additive 190 into the additive supply unit outer piping 118, and the vertical position of the additive supply unit centrifugal supply disc 134 relative to the additive supply unit outer piping bottom end 122.

In step 316, the additive supply unit outer piping bottom end 122 is retracted out of the cylindrical mixing container 102. Thus, when the blending cycle is complete, the additive supply unit centrifugal supply disc 134 stops, and the linear actuator 124 raises the additive supply unit 116 past the isolating valve 146.

In step 318, the isolating valve 146 is closed, isolating the moisture sensitive additive 190 from the moist environment.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

I claim:

1. A method for mixing of an additive material into a fluid, comprising:

a. providing an apparatus for mixing, said apparatus including a cylindrical mixing container (102), an additive supply unit (116), a linear actuator (124), an additive supply unit collar (130), an additive supply unit disc (134), an isolating valve (146), a motor (148), an outlet line (153), a pump (154), a fluid supply (156) and a restricting valve (158);

said cylindrical mixing container (102) having a mixing container top wall (104), a mixing container bottom wall (106), a mixing container sidewall (138), said cylindrical mixing container (102) having a cylindrical mixing container outlet (114) through said mixing container bottom wall (106) aligned with a longitudinal cylindrical mixing container axis (110), said cylindrical mixing container (102) having a cylindrical mixing container liquid inlet (112) through said mixing container sidewall (138) bounded at a cylindrical mixing container inlet bottom (142) by said cylindrical mixing container bottom wall (106) and generally tangentially disposed to an inner peripheral surface (150) of said cylindrical mixing container (102);

said additive supply unit (116) having an additive supply unit longitudinal axis (152) aligned with said longitudinal cylindrical mixing container axis (110), said additive supply unit (116) having an additive supply unit outer piping (118), said additive supply unit outer piping (118) having an additive supply unit outer piping top end (120) and an additive supply unit outer piping bottom end (122), said additive supply unit (116) having an additive supply unit inlet (126) into said additive supply unit outer piping (118) at said additive supply unit outer piping top end (120), said additive supply unit (116) having an additive supply unit shaft (128) slidably positioned within said additive supply unit outer piping (118) from said supply unit outer piping top end (120) to beyond said supply unit outer piping bottom end (122), said additive supply unit collar (130) at said supply unit outer piping bottom end (122) maintaining said additive supply unit shaft (128) on said additive supply unit longitudinal axis (152), said additive supply unit disc (134) affixed perpendicular to said additive supply unit shaft (128) at a bottom end of said additive supply unit shaft (128);

said motor (148) coupled to said additive supply unit shaft (128) for rotating said additive supply unit shaft (128);

said isolating valve (146) for terminating communication between said additive supply unit outer piping (118) and said cylindrical mixing container (102) when closed and for permitting communication between said additive supply unit outer piping (118)

and said cylindrical mixing container (102) when open, said isolating valve (146) positioned above said mixing container top wall (104);

said linear actuator (124) coupled to said additive supply unit (116), said linear actuator (124) adapted to withdraw said additive supply unit (116) from said cylindrical mixing container (102) and above said isolating valve (146) and to deploy said additive supply unit outer piping bottom end (122) into said cylindrical mixing container (102); and said outlet line (153) adapted for connection to said cylindrical mixing container outlet (114) and to said pump (154);

said fluid supply (156) adapted for communication with said restricting valve (158); and said restricting valve (158) adapted for terminating communication with said cylindrical mixing container liquid inlet when closed and for permitting communication with said cylindrical mixing container liquid inlet when open;

b. exerting a vacuum on said cylindrical mixing container (102);

c. opening said restricting valve to permit communication of said fluid from said fluid supply (156) to said cylindrical mixing container liquid inlet;

d. opening said isolating valve (146);

e. deploying said additive supply unit outer piping bottom end (122) into said cylindrical mixing container (102);

f. rotating said additive supply unit shaft (128) and said additive supply unit disc (134);

g. introducing said additive material into additive supply unit outer piping (118) at said additive supply unit inlet (126);

h. retracting said additive supply unit outer piping bottom end (122) out of said cylindrical mixing container (102); and i. closing said isolating valve (146).

2. The method for mixing of claim 1, wherein said motor (148) is magnetically coupled to said additive supply unit shaft (128).

3. The method for mixing of claim 1, where said restricting valve (158) includes a pressure controller (182).

* * * * *